United States Patent [19]

Smith et al.

[11] 4,386,154

[45] May 31, 1983

[54] VISIBLE LIGHT SENSITIVE, THERMALLY DEVELOPABLE IMAGING SYSTEMS

[75] Inventors: George H. Smith, St. Paul; Peter M. Olofson, Oakdale, both of Minn.

[73] Assignee: Minnesota Mining and Manufacturing Company, St. Paul, Minn.

[21] Appl. No.: 247,834

[22] Filed: Mar. 26, 1981

[51] Int. Cl.[3] ..... G03C 1/52

[52] U.S. Cl. ..... 430/336; 430/338; 430/344

[58] Field of Search ..... 430/340, 344, 336, 338

[56] References Cited

U.S. PATENT DOCUMENTS

| | | | |
|---|---|---|---|
| 3,502,476 | 3/1970 | Itano et al. | 430/344 |
| 3,598,592 | 8/1971 | Cescon | 430/340 |
| 3,729,313 | 4/1973 | Smith | 430/340 |
| 3,790,376 | 2/1974 | Hashiue et al. | 430/344 |

FOREIGN PATENT DOCUMENTS

| | | |
|---|---|---|
| 41-27544 | 8/1966 | Japan . |
| 51-941 | 1/1976 | Japan . |
| 51-43786 | 11/1976 | Japan . |
| 52-23806 | 6/1977 | Japan . |
| 52-25330 | 7/1977 | Japan . |

*Primary Examiner*—Won H. Louie, Jr.
*Attorney, Agent, or Firm*—Cruzan Alexander; Donald M. Sell; Mark A. Litman

[57] ABSTRACT

A thermally developable imaging system comprises a leuco dye, nitrate ion, and a spectrally sensitized compound selected from (1) aromatic iodonium salts and (2) compounds of photolyzable halogen atoms.

9 Claims, No Drawings

VISIBLE LIGHT SENSITIVE, THERMALLY DEVELOPABLE IMAGING SYSTEMS

TECHNICAL FIELD

The present invention relates to visible light-sensitive imaging systems and particularly to light-sensitive, thermally developable imaging systems comprising a leuco dye, nitrate ion, and a spectrally sensitized compound selected from (1) aromatic iodonium salts, and (2) compounds with photolyzable halogen atoms.

BACKGROUND ART

Imaging systems comprising a leuco dye, nitrate ion, and diazonium salts in a binder were disclosed in U.S. patent application Ser. No. 101,196 filed Dec. 7, 1979, abandoned. That system provides a light-sensitive, thermally developable, negative acting system. That is, the optical density in the final image is more dense in areas where light struck than in areas which are not light struck. The exact phenomenon by which that light-sensitive element functions is not completely understood.

Imaging systems comprising a leuco dye and nitrate ion in a binder are disclosed in U.S. patent application Ser. No. 101,197, filed Dec. 7, 1979. That system provides a light-insensitive, thermally developable system which provides optical density where heated.

Many other processes and compositions use leuco dyes to provide optical densities in the imaged article. For example, U.S. Pat. No. 4,017,313 uses a combination of a photosensitive leuco dye, a photo-sensitizer for the dye, an aromatic aldehyde and a secondary or tertiary amine. Other photosensitive systems using leuco dyes are included in U.S. Pat. Nos. 3,390,997, 2,884,326, and 2,772,284. The mechanism of these last two patents are disclosed in "Aromatic Aldehyde-Leuco Dye Photooxidation," H. D. Hartzler, *Pure and Applied Chemistry,* Vol. 49, pp. 353–356, Pergamon Press, 1977, Great Britain.

*Light-Sensitive Systems,* J. Kosar, 1965, John Wiley and Sons, Chapter 8, page 369, describes print-out photosensitive systems comprising a binder, leuco dye, organic halogen compound and photosensitizing dye. Because these are printout systems, there is no thermal amplification.

A great many photosensitive materials have been used in different imaging processes utilizing various photoinitiated phenomena such as photohardening of polymerizable materials (e.g., negative acting printing plates), photosolubilizing materials (e.g., positive acting printing plates), light initiated diazonium salt coupling reactions (e.g., diazonium microfilm), etc. A recently discovered class of iodonium photoinitiators for both cationic and epoxy polymerization (e.g., U.S. Pat. Nos. 4,026,705, and 3,981,897, and U.S. patent applications Ser. Nos. 467,899 filed May 8, 1974 and 40,645 filed May 21, 1979 in the name of George H. Smith) has also been proposed as equivalent to other photoinitiators in certain ethylenically unsaturated printing plate compositions (e.g., U.S. Pat. No. 3,741,769).

SUMMARY OF THE INVENTION

A novel photothermographic imaging composition has been found which comprises leuco dye, nitrate ion, sensitizing dye, and a photoinitiator selected from the class consisting of (1) diaryliodonium salts, or (2) photolyzable organic halogen compounds. These compositions are preferably carried in a binder such as a polymeric binder. The composition acts as a negative image forming system in that the greatest image density is formed upon heat development in the light struck areas. Latent images are formed upon exposure to visible light and stable images are then formed by heat development. Therefore no wet processing steps or fixing steps are needed.

Sensitivity to visible light (that is the exposure necessary to enable the generation of images) of less than 15 mj/cm$^2$ and even less than 4 mg/cm$^2$ is readily attained with the compositions of the present invention. This speed is remarkable for non-silver imaging systems and clearly shows that amplification is occurring.

DETAILED DESCRIPTION OF THE INVENTION

Each of the two classes of photoinitiators are known in the art.

The diaryliodonium salts of the present invention may be generally described by the formulae:

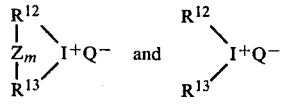

wherein $R^{12}$ and $R^{13}$ are individually selected from aromatic groups. Such aromatic groups may have from 4 to 20 carbon atoms (e.g., substituted or unsubstituted phenyl, naphthyl, thienyl, and furanyl with substantially any substitution, Z is selected from a carbon-to-carbon bond, oxygen, sulfur,

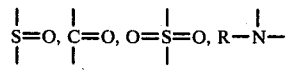

wherein R is aryl (e.g., 6 to 20 carbon atoms) or acyl (e.g. 2 to 20 carbon atoms), or $R^3$—C—$R^5$ wherein $R^4$ and $R^5$ are selected from hydrogen, alkyl groups of 1 to 4 carbon atoms, and alkenyl of 2 to 4 carbon atoms, m is 0 or 1, and $Q^-$ is any anion.

Where the term group is used in describing substituents, substitution is anticipated on the substituent for example, alkyl group includes ether groups (e.g., $CH_3$—$CH_2$—O—$CH_2$—), haloalkyls, nitroalkyls, carboxyalkyls, hydroxyalkyls, etc. while the term alkyl includes only hydrocarbons. Substituents which react with active ingredients, such as very strong reducing or oxidizing substituents, would of course be excluded as not being sensitometrically inert or harmless.

The photolyzable organic halogen compounds are those that upon exposure to radiation dissociate at one or more carbon-halogen bonds to form free radicals. The carbon-halogen bond dissociation energy should be between about 40 and 70 kilo calories per mole as taught in U.S. Pat. Nos. 3,515,552 and 3,536,481. Preferred halogen compounds are non-gaseous at room temperature and have a polarographic half-wave reduction potential greater than about −0.9 V as described in U.S. Pat. Nos. 3,640,718, 3,617,288, and 3,779,778.

Examples of diaryliodonium cations useful in the practice of the present invention are diphenyliodonium, 4-chlorophenylphenyliodonium, di(4-chlorophenyl)iodonium, 4-trifluoromethylphenylphenyliodonium, 4-ethylphenylphenyliodonium, di(4-acetylphenyl)iodonium, tolylphenyliodonium, anisylphenyliodonium, 4-butoxyphenylphenyliodonium, di(4-phenylphenyl)iodonium, di(carbomethoxyphenyl)iodonium, etc. Examples of these iodonium cations are disclosed in U.S. Pat. Nos. 3,729,313, and 4,076,705.

Examples of photolyzable organic halogen compounds are hexabromoethane, tetrabromoxylene, carbon tetrabromide, m-nitro-tribromoacetyl benzene, trichloroacetanilide, trichlorosulfonyl benzene, tribromoquinaldine, bis-(pentachloro)cyclopentadiene, tribromomethylquinoxaline, α,α-dibromo-p-nitrotoluene, hexachloro-p-xylene, dibromotetrachloroethane, pentabromoethane, dibromodibenzoylmethane, carbon tetraiodide, halomethyl-s-triazines such as, 2,4-bis(trichloromethyl)-6-methyl-s-triazine, 2,4,6-tris(trichloromethyl)-s-triazine, and 2,4-bis(trichloromethyl)-6-p-methoxystyryl-s-triazine, etc. These compounds are disclosed, as noted above, in U.S. Pat. Nos. 3,515,552, 3,536,489, 3,617,288, 3,640,718 and 3,779,778.

A wide variety of sensitizing dyes for the diaryliodonium, and photolyzable organic halogen compounds are known in the art. U.S. Pat. Nos. 3,729,313 and 3,808,006 show a variety of sensitizing dyes for the iodonium salts. Most of these dyes will also sensitize the photolyzable organic halogen compounds. A simple test can be used to determine whether or not a dye will sensitize any of the two classes of photosensitizers. This test is described in U.S. Pat. No. 3,808,006 and may be used as follows:

Illustrative sensitizing dyes are those in the following categories: diphenylmethane, xanthene, acridine, methine and polymethine, thiazole, thiazine, azine, aminoketone, porphyrin, colored aromatic polycyclic hydrocarbons, p-substituted aminostyryl compounds and aminotriaryl methanes. To determine whether any compound is a sensitizer for the diaryliodonium compounds or halogen compounds, the following standard test procedure may be employed, this being definitive of those sensitizers falling within the scope of the present invention.

A standard test solution is prepared with the following composition:

- 5.0 parts of a 5% (weight by volume) solution in methanol of polyvinyl butyral (45,000–55,000 molecular weight, 9.0–13.0% hydroxyl content "Butvar B76" is a trademarked product of Monsanto Chem. Co.)
- 0.3 parts of trimethylol propane trimethacrylate
- 0.03 parts of 2-methyl-4,6-bis(trichloromethyl) s-triazine.

To this solution is added 0.01 part of the material to be tested as a sensitizer. The solution is knife coated onto a 2 mil clear polyester film using a knife orifice of 2.0 mil, and the coating is air dried for about 30 minutes. Another 2 mil clear polyester film is carefully placed over the dried but soft and tacky coating with minimum entrapment of air. The sandwich construction is then exposed for three minutes to 15,000 foot candles of incident light from a tungsten light source providing light in both the visible and ultraviolet range (General Electric 650 watt FCH quartz-iodine lamp).

Exposure is made through a stencil with a Corning Glass filter (3–74) between the light and the stencil to filter out ultraviolet radiation so as to provide exposed and unexposed areas in the construction. After exposure the cover film is removed, and the coating is treated with a finely divided colored powder, such as a color toner powder of the type conventionally used in xerography. If the tested material is a sensitizer, the trimethylol propane trimethacrylate monomer in the light exposed areas will be polymerized by the light generated free radicals from the photolyzable organic halogen compound, i.e., 2-methyl-4,6-bis(trichloromethyl)-s-triazine. Since the polymerized areas are essentially tack free, the colored powder will selectively adhere only to the tacky, unexposed areas of the coating, providing a visual image corresponding to that in the stencil.

Although the concentration ratio of sensitizer to photosensitive compound is not critical and will depend on such factors as the desired use, the selection of sensitizer, the selection of diaryliodonium compound, etc., generally the molar concentration ratio is between 1/100 and 2/1, respectively, and preferably between 1/70 to 1/2, sensitizer to photosensitive compound. Coatings, layers, films or sheets made from solutions or dispersions of these ingredients, with or without a suitable binder, are quite stable in the absence of light and can be stored for extended periods under ordinary room conditions.

Any natural or synthetic water-insoluble polymeric binder may be used in the practice of the present invention. Organic polymeric resins, preferably thermoplastic resins (although thermoset resins may be used), are generally preferred. Where speed is more important, water-insoluble, water impermeable, water resistant polymers should be used and an acid should be added to the system to increase the rate of colorizing (i.e., leuco dye oxidation). Such resins as phenoxy resins, polyesters, polyvinyl resins, polycarbonates, polyamides, polyvinyl butyral, polyvinylidene chloride, polyacrylates, cellulose esters, copolymers and blends of these classes or resins, and others have been used with particular success. Where the proportions and activities of leuco dyes and nitrate ion require a particular developing time and temperature, the resin should be able to withstand those conditions. Generally it is preferred that the polymer not decompose or lose its structural integrity at 200° F. (93° C.) for 30 seconds and most preferred that it not decompose or lose its structural integrity at 260° F. (127° C.) for 30 seconds. Preferred polymers are Saran and phenoxy resins (e.g., PKHH and PAHJ supplied by Union Carbide Chemical Corp.).

Beyond these minimal requirements, there is no criticality in the selection of a binder. In fact, even transparency and translucency are not required, although they are desirable. Where, for example, the polymer is itself an opaque white, the light struck and thermally treated area will become colored and the non-treated areas will remain white.

The binder serves a number of additionally important purposes in the constructions of the present invention. The imageable materials are protected from ambient conditions such as moisture. The consistency of the coating and its image quality are improved. The durability of the final image is also significantly improved. The binder should be present as at least about 25% by weight of ingredients in the layer, more preferably as 50% or 70% by weight and most preferably as at least about 80% by weight of dry ingredients (i.e., excluding solvents in the layer). A generally useful range is 30–98 percent by weight binder with 75 to 95 percent preferred.

Nitrate salts are themselves well known. They may be supplied as various chemical compounds, but are desirably provided as a metal salt, and most preferably provided as a hydrated metal salt. Other ions which are ordinarily good oxidizing ions such as nitrite, chlorate, iodate, perchlorate, periodate, and persulfate do not provide comparable results. Extremely active oxidizing agents, such as iodate, even used in relatively smaller proportions to prevent complete and immediate oxidation or colorization of dyes do not perform nearly as well as nitrate ion compositions. The performance of nitrate is so far superior to any other ion that it is apparently unique in the practice of the present invention.

Most means of supplying the nitrate salt into the composition are satisfactory. E.g., organic salts, metal salts, acid salts, mixtures of acids and salts, and other means of supplying the ion are useful. For example, nitrates of zinc, cadmium, potassium, calcium, zirconyl ($ZrO_2$), nickel, aluminum, chromium, iron, copper, magnesium, lead and cobalt, ammonium nitrate, and cerous ammonium nitrate have been used.

The nitrate salt component of the present invention is desirably present in a form within the imaging layer so that oxidizing quantities of $HNO_3$, NO, $NO_2$, or $N_2O_4$ will be provided within the layer when it is heated to a temperature no greater than 200° C. for 60 seconds and preferably no greater than 160° C. for 60 or most preferably 30 seconds. This may be accomplished with many different types of salts, both organic and inorganic, and in variously different types of constructions.

The most convenient way of providing such thermal oxidant providing nitrate salts is to provide a hydrated nitrate salt such as aluminum nitrate nonahydrate ($Al(NO_3)_2.9H_2O$).

In addition to hydrated nitrate salts, nonhydrated salts ammonium nitrate, pyridinium nitrate, and quanidinium nitrate in an acidic environment are also capable of providing the oxidizing capability necessary for practice of the present invention.

Beside the inorganic types of salts generally described above, organic salts in non-alkaline environments are also quite useful in the practice of the present invention. In particular, nitrated quaternary ammonium salts such as guanadinium nitrate work quite well in acid environments, but will not provide any useful image in a basic environment.

It is believed that the alkaline environment causes any oxidizing agent (e.g., $HNO_3$, NO, $NO_2$ and/or $N_2O_4$) which is liberated from the nitrate salt to be neutralized so as to prevent oxidation of the leuco dyes. For this reason it is preferred to have an acid environment for the nitrate salt.

One other consideration should be given in the selection of the nitrate salt and that is the choice of a salt in which the cation is non-reactive with the dye. Non-reactive salts are defined in the practice of the present invention as those salts the cations of which do not spontaneously oxidize the dyes that they are associated with at room temperature. This may be readily determined in a number of fashions. For example, the dye and a non-nitrate (preferably halide) salt of the cation may be codissolved in a solution. If the salt oxidizes the dye spontaneously (within two minutes) at room temperature, it is a reactive salt. Such salts as silver nitrate, in which the cation is itself a strong oxidizing agent, is a reactive salt. Ceric nitrate is also reactive, while hydrated cerous nitrate is not.

Preferred salts are the hydrated metal salts such as nickel nitrate hexahydrate, magnesium nitrate hexahydrate, aluminum nitrate nonahydrate, ferric nitrate nonahydrate, cupric nitrate trihydrate, zinc nitrate hexahydrate, cadmium nitrate tetrahydrate, bismuth nitrate pentahydrate, thorium nitrate tetrahydrate, cobalt nitrate hexahydrate, gadolinium or lanthanum nitrate nonahydrate, mixtures of these hydrated nitrates and the like. Nonhydrated or organic nitrates may be admixed therewith.

It is preferred to have at least 0.10 moles of nitrate ion per mole of leuco dye. It is most preferred to have at least 0.30 to 0.50 moles of ion per mole of dye. Even amounts of 1.0 mole of nitrate ion per mole of dye have been found useful. The nitrate ordinarily constitutes from 0.05 to 10 percent by weight of the imaging layer, preferably 0.1 to 10 and most preferably 0.5 to 8 percent by weight.

Leuco dyes are well known. These are colorless compounds which when subjected to an oxidation reaction form colored dyes. These leuco dyes are well described in the art (e.g., U.S. Pat. No. 3,974,147, *The Theory of the Photographic Process,* 3rd Ed., Mees and James, pp. 283–4, 390–1, Macmillion Co., N.Y.; and *Light-Sensitive Systems,* Kosar, pp. 367, 370–380, 406 (1965) Wiley and Sons, Inc., N.Y.). Only those leuco dyes which can be converted to colored dyes by oxidation are useful in the practice of the present invention. In fact, only one class of leuco dyes has been found to work. This class, comprised of acylated leuco azine, phenoxazine, and phenothiazine dyes, may in part be represented by the structural formula:

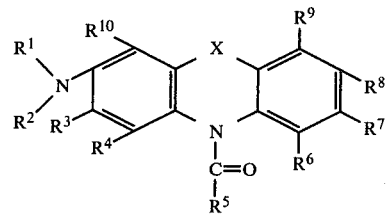

wherein

X is selected from O, S, and $$-\overset{|}{N}-R^{11}$$

and is preferably S, $R^1$ and $R^2$ are independently selected from H and alkyl groups of 1 to 4 carbon atoms, $R^3$, $R^4$, $R^6$ and $R^7$ are independently selected from H and alkyl groups of 1 to 4 carbon atoms, preferably methyl, $R^5$ is selected from alkyl groups of 1 to 16 carbon atoms, alkoxy groups of 1 to 16 carbon atoms, and aryl groups of up to 16 carbon atoms, $R^8$ is selected from $$-\underset{\underset{R^2}{|}}{N}-R^1,$$

H, alkyl groups of 1 to 4 carbon atoms wherein $R^1$ and $R^2$ are independently selected and defined as above, $R^9$ and $R^{10}$ are independently selected from H, and alkyl groups of 1 to 4 carbon atoms, and $R^{11}$ is selected from alkyl groups of 1 to 4 carbon atoms and aryl groups of up to 11 carbon atoms (preferably phenyl groups).

Acid or base sensitive dyes such as phenolphthalein and other indicator dyes are not useful in the present invention nor are leuco triaryl methane dyes or styryl dyes. Indicator dyes would only form transient images or would be too sensitive to changes in the environment. Triarylmethane and styryl leuco dyes which are generally preferred in the imaging systems of the prior art were found to be highly unstable in the present systems and provided unsatisfactory color differential between the light exposed areas and unexposed areas after heat development.

The leuco dye should be present as at least about 0.3% by weight of the total weight of the light sensitive layer, preferably at least 1% by weight, and most preferably at least 2% to 10% or more (e.g., 15%) by weight of the dry weight of the imageable layer. Generally about 10 mole percent nitrate/leuco dye is minimally used, with at least 20 to 80 mole percent preferred and from 35 to 65 mole percent most preferred. Molar percentages of nitrate/dye in excess of 100% are definitely useful. The leuco dye ordinarily constitutes from 0.5 to 15% by weight of the imaging layer preferably 2 to 8 percent.

Acidic materials are added to the light sensitive layer to increase its speed. The acids useful in the present invention are acids as generally known to the skilled chemist. Organic acids are preferred, but inorganic acids (generally in relatively smaller concentrations) are also useful. Organic acids having carboxylic groups are more preferred. The acid should be present as at least about 0.1% by weight of the total weight of the light sensitive layer. More preferably it is present in amounts from 0.2 to 2.0 times the amount of nitrate ion. The acid may, for example, be present in a range of from 0.05 to 10 percent by weight, preferably from 0.1 to 7 percent, most preferably from 0.5 to 5 percent. High molecular weight acids are generally used at the higher concentrations and lower molecular weight acids used at the lower concentrations. Anhydrides such as phthalic anhydride may also be used.

In forming or coating imageable layers onto a substrate, temperatures should, of course, not be used during manufacture which would completely colorize the layer or decompose the photoinitiators. Some colorization is tolerable, with the initial leuco dye concentrations chosen so as to allow for anticipated changes. It is preferred, however, that little or no leuco dye be oxidized during forming or coating so that more standardized layers can be formed. Depending on the anticipated development temperature, the coating or forming temperature can be varied. Therefore, if the anticipated development temperature were, for example, 220° F. (104° C.), the drying temperature could be 140° F. (60° C.). It would therefore not be likely for the layer to gain any of its optical density at the drying temperature in less than 6–7 minutes. A reasonable development temperature range is between 160° F. (71° C.) and 350° F. (177° C.) and a reasonable dwell time is between 3 seconds and 2 minutes, preferably at between 175° F. (79° C.) and 250° F. (121° C.) and for 5 to 60 seconds, with the longer times most likely associated with the lower development temperatures.

The photoinitiators should be present as at least 0.1% by weight of the dried imaging layer, up to 15% by weight or more. Preferably they are present at from 0.3 to 10% by weight of the layer and most preferably from 0.5 to 5%. The sensitizing dye should be present in amounts less than 0.5 times the amount of photoinitiator, preferably less than 0.3 times, and most preferably less than 0.2 times the amount of the photoinitiator. Amounts equal to or greater than 0.5 times the amount of photoinitiators may be used, but this tends to add undesired coloration to the sheet.

The imaging layers of the present invention must under some conditions allow reactive association amongst the active ingredients in order to enable imaging. That is, the individual ingredients may not be separated by impenetrable barriers (i.e., which cannot be dissolved, broken or disrupted during use) within the layer, as in dispersed immiscible phases. Generally, the active ingredients are homogeneously mixed (e.g., a molecular mixture of ingredients) within the layer. They may be individually maintained in heat softenable binders which are dispersed or mixed within the layer and which soften upon heating to allow migration of ingredients, but this would require a longer development time.

The imaging layers of the present invention may contain various materials in combination with the essential ingredients of the present invention. For example, plasticizers, coating aids, antioxidants (e.g., ascorbic acid, hindered phenols, phenidone, etc. in amounts that would prevent premature oxidation of the dyes when heated), surfactants, antistatic agents, waxes, ultraviolet radiation absorbers, mild oxidizing agents in addition to the nitrate, and brighteners may be used without adversely affecting practice of the invention.

These and other aspects of the present invention will be shown in the following examples.

EXAMPLE 1

The following components were mixed and shaken at room temperature in a dark room to prepare a coating solution. This solution was knife coated at 4.5 mils ($11.43\times10^{-3}$ cm) onto 3 mil ($7.6\times10^{-3}$ cm) polyethyleneterephthalate film. This was then oven dried for seven minutes at 60° C.

1.5 g of a copolymer of acrylonitrile and vinylidene chloride
3.5 g of methylethylketone
0.09 g benzoyl leuco methylene blue
0.026 g $Mg(NO_3)_2.6H_2O$
0.004 g trimesic acid
0.004 g ascorbic acid
0.9 g methanol
0.08 g diphenyliodonium nitrate
0.002 g 5,10-diethoxy-16,17-dimethoxyviolanthrene Samples of the dried element were exposed to a 75 Watt tungsten light source at a distance of 5 inches (12.7 cm). A photographic step wedge was placed on top of the sample while a fifteen second exposure was made. The exposed sample was then heat developed at 85° C. for about 20 seconds. Four steps of dense blue color measuring greater than 1.2 optical density units were obtained.

EXAMPLE 2

The same formulation of Example 1, except that the diphenyliodonium nitrate was replaced with diphenyliodonium hexafluorophosphate, was used to prepare another element in the same manner. A five second exposure to the same light source followed by development at 85° C. produced two steps of optical density greater than 1.2.

EXAMPLE 3

The formulation of Example 2, except that the nitrate salt used was $Ni(NO_3)_2.6H_2O$, was used to prepare an element otherwise identical to that of Example 2. A 10 second exposure to the same source followed by the same thermal development yielded three steps of optical density greater than 1.2.

EXAMPLE 4

An equimolar substitution of $Ce_2Mg_3(NO_3)_{12}.27H_2O$ for the nitrate salt of Example 2 yielded an element which provided essentially identical results upon imaging and development.

EXAMPLE 5

Example 1 was repeated except that equimolar substitution was made of bis(2,4-dimethylphenyl)-iodonium hexafluoroantimonate for diphenyliodonium nitrate and Acridine Orange was substituted for the sensitizing dye 5,10-diethoxy-16,17-dimethoxy violanthrene. After a thirty second light exposure and sixty second development at 85° C., three steps of optical density greater than 1.2 were produced. It was found that higher development temperatures and shorter development times could be used to obtain substantially similar results.

EXAMPLE 6

Example 1 was repeated except that an equimolar amount of 3,3-diethylthiadicarbocyanine iodide replaced the violanthrene sensitizing dye. The dried coated film provided three steps of optical density greater than 1.2 with a five second exposure and thirty second development at 85° C. The maximum spectral sensitivity of the coating was at about 650 nm.

EXAMPLES 7-10

Example 1 was repeated by substituting equimolar amounts of the following compounds for the iodonium salts:

$C_6H_5N^+(CH_3)_3SbF_6^-$ $C_6H_5N^+(CH_3)_2(CH_2C_6H_5)SbF_6^-$ $(C_6H_5)_3P^+(CH_2C_6H_5)PF_6^-$ $(C_6H_5)_3S^+SbF_6$

Even though these salts are shown in the prior art to be photoinitiators having the same general properties as the iodonium photoinitiators, they did not produce images under the same conditions of exposure and development used in Example 1.

EXAMPLES 11-17

The general formulation of coating solutions used in these examples were prepared by mixing, in parts by weight:

5.0 parts of a copolymer of acrylonitrile and vinylidene chloride
0.09 parts benzoyl leuco methylene blue
0.026 parts $Mg(NO_3)_2.6H_2O$
0.9 parts methanol
0.004 parts trimesic acid
0.004 parts ascorbic acid
0.04 to 0.08 parts photoinitiator
0.002 to 0.008 parts sensitizing dye These solutions, with the appropriate photoinitiators and sensitizing dyes, were knife coated at about 20 micrometers onto polyester film. The coating was then oven dried for seven minutes at 60° C. Samples of the dried coatings were then exposed to a seventy five Watt tungsten lamp at a distance of 12.7 cm. The light intensity at that distance measured approximately 600 foot candles. A photographic step tablet was placed on top of each sample during exposure. After light exposure, the samples were heated from ten to eighty seconds at 85° C. to develop the positive dye image. The number of steps providing an optical density of at least 1.2 were measured. Diethoxydimethoxyviolanthrene was used as the sensitizing dye in all examples except for Example 13 where rubrene was used. The data are presented in the table below.

| Example | Photoinitiator | Exposure Time | Steps |
|---|---|---|---|
| 11 | $(C_6H_5)_2IPF_6$ | 5 | 2 |
| 12 | $(C_6H_5)_2INO_3$ | 10 | 3 |
| 13 | $(C_6H_5)_2IPF_6$ | 10 | 1 |
| 14 | $CH_3C_3N_3(CCl_3)_2$ | 5 | 2 |
| 15 | $CBr_4$ | 5 | 2 |
| 16 | $C_2Br_6$ | 5 | 2 |
| 17 | $C_2Cl_2Br_4$ | 5 | 2 |

EXAMPLE 18

The following components were mixed and shaken at room temperature under red light to prepare a coating solution. This solution was knife coated at 4.5 mils ($11.43\times10^{-3}$ cm) onto 3 mil ($7.6\times10^{-3}$ cm) polyethylene terephthalate film. The coating was then oven dried for seven minutes at 60° C.

0.08 g benzoyl leuco methylene blue
0.026 g $Mg(NO_3)_2.6H_2O$
0.016 g trimesic acid
0.06 g $CH_3C_3N_3(CCl_3)_2$
0.9 methanol
0.002 g 5,10-diethoxy-16,17-dimethoxyviolanthrene
5.0 g 30% solution of Phenoxy PKHH in methyl ethyl ketone Samples of the dried element were exposed to a 75 W tungsten light source at a distance of 5 inches (12 cm). A photographic step wedge was placed on top of the sample while a three second exposure was made. The exposed sample was then heat developed at 105° C. for about 6 seconds. Three steps of dense blue color measuring greater than 1.0 optical density units were obtained.

EXAMPLE 19

The same formulation as in Example 18 was used, except that the benzoyl leuco methylene blue was replaced with 3,7-bis(diethylamino)-10-acetyl phenoxazine, to prepare another element in the same manner. A ten second exposure and 25 second heat development at 95° C. produced three steps of dense color.

What is claimed is:

1. An imageable layer comprising a binder, at least one leuco dye selected from an acylated azine, phenoxazine, or phenothiazine leuco dye, nitrate ion, a diaryliodonium salt photoinitiator, and a visible light sensitizing dye for said photoinitiator.

2. The imageable layer of claim 1 wherein said leuco dye is represented by the formula

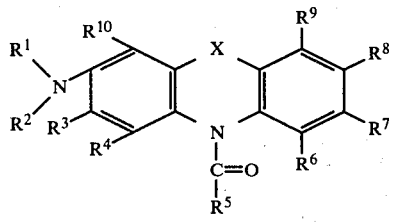

wherein

X is selected from O, S, and —N—$R^{11}$ $R^1$ and $R^2$ are independently selected from H and alkyl groups of 1 to 4 carbon atoms, $R^3$, $R^4$, $R^6$ and $R^7$ are independently selected from H and alkyl groups of 1 to 4 carbon atoms, $R^5$ is selected from alkyl groups of 1 to 16 carbon atoms, alkoxy groups of 1 to 16 carbon atoms, and aryl groups of up to 16 carbon atoms, $R^8$ is selected from $-\underset{\underset{R^2}{|}}{N}-R^1$, H, and alkyl groups of 1 to 4 carbon atoms wherein $R^1$ and $R^2$ are independently selected and defined as above, and $R^9$ and $R^{10}$ are independently selected from H, alkyl groups of 1 to 4 carbon atoms, and $R^{11}$ is selected from alkyl groups of 1 to 4 carbon atoms and aryl groups of up to 16 carbon atoms.

3. The imageable layer of claim 2 which, as parts by weight of said layer, comprises at least 0.5% leuco dye, at least 0.5% photoinitiator, at least 0.05% sensitizer dye, and at least 0.10 moles nitrate ion per mole of leuco dye.

4. The imageable layer of claim 3 wherein said photoinitiator is a diphenyliodonium salt.

5. The imageable layer of claim 3 wherein said leuco dye is represented by the formula

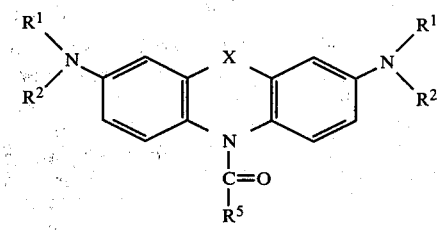

wherein $R^1$ and $R^2$ are independently selected from H and alkyl of 1 to 4 carbon atoms, $R^5$ is selected from (a) alkyl groups of 1 to 16 carbon atoms, and (b) aryl groups of up to 16 carbon atoms which may be substituted with up to two groups selected from the class consisting of alkyl groups of 1 to 5 carbon atoms, alkoxy groups of 1 to 5 carbon atoms, halogen, CN, and $NO_2$, and X is S, O, or —N—$R^{11}$.

6. The imageable layer of claims 1, 2, 3, 4, or 5 wherein said nitrate ion is present in the form of a metal salt of nitrate.

7. The imageable layer of claims 1, 3, 4, or 5 wherein said nitrate ion is in the layer as a hydrated metal nitrate salt, said leuco dye is present as at least 2% by weight of said layer, said photoinitiator is present as from 2 to 8% by weight of said layer, said binder comprises at least 80% by weight of said layer, and said layer also contains an organic acid.

8. The imageable layer of claim 5 wherein $R^1$ is the same as $R^2$ and is selected from the group consisting of methyl and ethyl.

9. A process for forming an image comprising exposing the layer of claims 1, 2, 3 or 4 to visible light and heating the exposed layer to generate a visible image.

* * * * *